US005737997A

United States Patent [19]

Sato et al.

[11] Patent Number: 5,737,997

[45] Date of Patent: Apr. 14, 1998

[54] CAM PLATE SUPPORTING STRUCTURE IN A CAM PLATE TYPE COMPRESSOR

[75] Inventors: Hirofumi Sato; Tomoji Tarutani; Norikazu Deto; Masanobu Yokoi, all of Kariya, Japan

[73] Assignee: Kabushiki Kaisha Toyoda Jidoshokki Seisakusho, Japan

[21] Appl. No.: 694,407

[22] Filed: Aug. 12, 1996

[30] Foreign Application Priority Data

Aug. 21, 1995 [JP] Japan ..... 7-212204

[51] Int. Cl.[6] ..... F01B 3/00

[52] U.S. Cl. ..... 92/71; 417/269; 74/60

[58] Field of Search ..... 92/12.2, 71; 91/499; 417/269; 74/60

[56] References Cited

U.S. PATENT DOCUMENTS

| | | | |
|---|---|---|---|
| 3,817,660 | 6/1974 | Knowles et al. | 417/269 |
| 4,454,779 | 6/1984 | Vos | 74/60 |
| 5,233,913 | 8/1993 | Mulrhead | 92/71 |
| 5,433,137 | 7/1995 | Ikeda et al. | 74/60 |
| 5,636,974 | 6/1997 | Ikeda et al. | 417/269 |

FOREIGN PATENT DOCUMENTS

| | | | |
|---|---|---|---|
| 56-96185 | 8/1981 | Japan | 417/269 |
| 64-3118 | 1/1989 | Japan . | |
| 7-197883 | 8/1995 | Japan . | |

*Primary Examiner*—Thomas E. Denion

*Attorney, Agent, or Firm*—Woodcock Washburn Kurtz Mackiewicz & Norris LLP

[57] ABSTRACT

A cam plate type compressor includes a cam plate having a boss and the cam plate is located in a crank chamber formed within a pair of casings. The cam plate is rotatable with a drive shaft. The compressor also has two-part bearing structure for supporting the cam plate. The bearing has a buffer structure for absorbing an axial load applied to the cam plate. One of the bearing parts is constituted by a rolling bearing and the other is constituted by a flat sliding bearing.

11 Claims, 3 Drawing Sheets

CAM PLATE SUPPORTING STRUCTURE IN A CAM PLATE TYPE COMPRESSOR

BACKGROUND OF THE INVENTION

1. Field of the Invention

The present invention relates to a cam plate type compressor of the type used in vehicle air conditioners.

2. Description of the Related Art

In a swash plate type compressor, which is a variation of a cam plate type compressor, a drive shaft is rotatably supported in the center of a pair of coupled cylinder block. A swash plate is fixed to the central periphery of the drive shaft with a boss. The swash plate integrally rotates with the drive shaft. A plurality of double-headed pistons are coupled to the swash plate. The swash plate transmits rotation of the drive shaft into reciprocation of the pistons. The pistons compress refrigerant gas in cylinder bores. A resultant thrust load is received by rolling bearings located between the ends of the swash plate and pressure bearing seats of the cylinder block.

Typically, an annular projection is formed on the front end face and on the rear end face of the boss. Each cylinder block also has an annular projection on the corresponding surfaces on the cylinder block facing the boss. The projections formed on the faces on the boss portion and those formed on the cylinder blocks have different diameters. The rolling bearings each have a pair of elastic races and are located between the annular projections of the boss and the annular projections of the cylinder block. The rolling bearings together with the annular projections serve as buffer mechanism.

However, the buffer mechanism lacks the rigidity necessary for supporting the swash plate. When driving a compressor, a lack of rigidity in the supporting structure of the swash plate causes the swash plate to start slightly yawing with respect to the cylinder blocks. Since the yawing of the swash plate may vibrate the compressor, the swash plate needs to be held tightly by the cylinder block. However, tightness causes excessive resistance to the rolling movement of the rolling bearings and therefore increases power losses.

In order to solve the above described problem, a swash plate type compressor shown in FIG. 4 cited from The Japanese Unexamined Patent Publication No. 7-197883 has only one buffer mechanism 70. The single buffer mechanism 70 is located on a face, namely on the rear end face of the boss 61*a* of the swash plate 61. This design improves the rigidity of the whole buffer mechanism 70. On the other hand, the front end face 61*b* of the boss portion 61*a* and the pressure bearing seat 62*a* of the cylinder block facing the face 61*b* are formed flat. A rolling bearing 63 is placed between the pressure receiving seat 62*a* and the face 61*b*. This arrangement restricts elastic deformation of the bearing 63.

A second compressor, which is an improved version of the first one, has a pair of rolling bearings located on the rear end face and front end face of the swash plate. Therefore, reduction of vibration and noise accompanying the rolling movement of the rolling bearing, is not sufficiently improved in the second compressor.

SUMMARY OF THE INVENTION

Accordingly, it is an objective of the present invention to provide a cam plate type compressor that sufficiently reduces vibration and noise in the support structure of the cam plate.

The invention is basically a cam plate type compressor including a housing, a crank chamber formed within the housing and a drive shaft. A cam plate is supported by the drive shaft and located in the crank chamber. The cam plate has a rotational axis, and the cam plate receives a load in the axial direction. A boss is formed between the cam plate and the drive shaft for supporting the cam plate. The boss has first and second end surfaces axially spaced from one another, and the first end surface is flat. Further included is a first bearing seat located to face the first end surface, wherein the first bearing seat is flat. A second bearing seat is located to face the second end surface. A first bearing located between the first end surface and the first seat and a second bearing is located between the second end surface and the second seat. A buffer means is provided for absorbing the axial load. Either the first or the second bearing is a rolling bearing and the other is a sliding bearing.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a swash plate type compressor embodying the present invention will be described below with reference to FIGS. 1 and 2.

Figure 1:
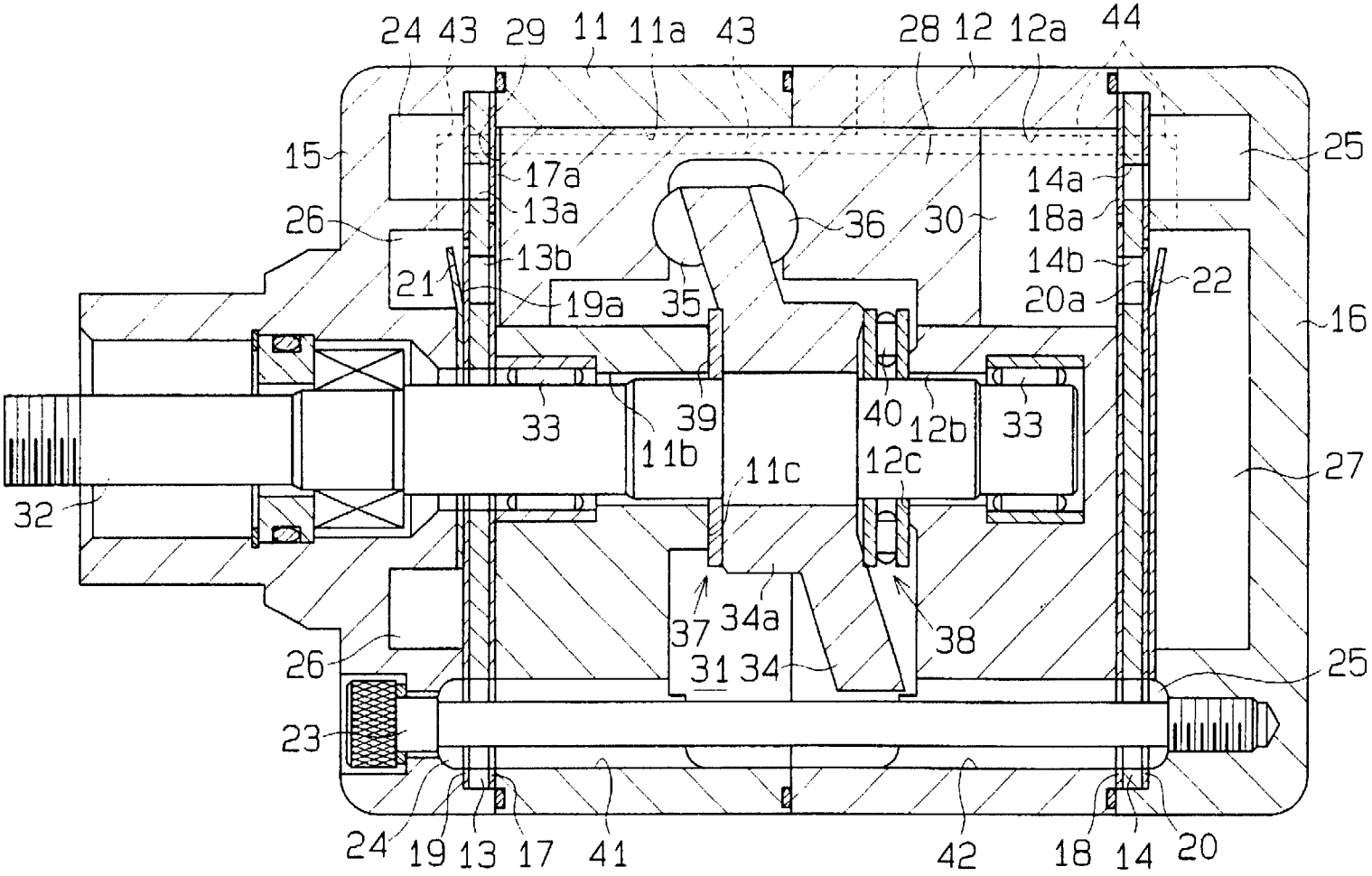
FIG. 1 is a sectional view of a compressor according to the first embodiment of the present invention.

As shown in FIG. 1, a front cylinder block 11 and a rear cylinder block 12 are secured to each other at their central part. A front housing 15 is secured to the front end face of the front cylinder block 11 through a valve plate 13. A rear housing 16 is secured to the rear end face of the rear cylinder block 12 through a valve plate 14.

Valve disks 17 and 18, forming suction valves 17*a* and 18*a*, are located between the cylinder block 11 and the valve plate 13 and between the cylinder block 12 and the valve plate 14, respectively. Valve disks 19 and 20, forming discharge valves 19*a* and 20*a*, are located between the valve plate 13 and the front housing 15 and between the valve plate 14 and the rear housing 16, respectively. Retainer plates 21 and 22 are located between the valve disk 19 and the front housing 15 and between the valve disk 20 and the rear housing 16, respectively. The retainer plate 21 regulates the degree of opening of the discharge valve 19*a*. Likewise, the retainer plate 22 regulates the degree of opening of the discharge valve 20*a*. The cylinder blocks 11 and 12, the valve plates 13, 14, valve disks 17, 18, 19 and 20 and the retainer plates 21 and 22 are integrally clamped and fixed by a plurality of bolts 23. The front housing 15 and the front cylinder block 11 constitute a front casing and the rear cylinder block 12 and the rear housing 16 constitute a rear casing.

Discharge chambers 26 and 27 are formed in the center portions of the front and rear housings 15 and 16, respectively. Suction chambers 24 and 25 are formed in the front and rear housings 15 and 16 around the discharge chambers 27 and 28. A plurality of aligned pairs of cylinder bores 11*a* and 12*a* are formed parallel in the cylinder blocks 11 and 12. A double-headed piston 28 is housed in each corresponding pair of cylinder bores 11*a* and 12*a*. Compression chambers 29 and 30 are formed in the cylinder bores 11*a* and 12*a* by the piston 28. A suction port 13*a* is formed in the valve plate 13 so that the suction chamber 24 and the compression chamber 29 are connected with each other. A suction port 14*a* is formed in the valve plate 14 so that the suction chamber 25 and the compression chamber 30 are connected with each other. When a piston is in a suction stroke, refrigerant gas in the suction chambers 24 and 25 opens the suction valves 17*a* and 18*a* and is drawn into the compression chambers 29 and 30. When a piston is in a discharge stroke, the refrigerant gas opens the discharge valves 19*a* and 20*a* and is discharged to the discharge chambers 26 and 27.

A crank chamber 31 is formed in the central portion of the cylinder blocks 11 and 12. A drive shaft 32 is rotatably supported in center bores 11*b* and 12*b* of both the cylinder blocks 11 and 12 through radial needle bearings 33. The drive shaft 32 is rotated by an external power source such as an engine of a vehicle. A swash plate 34 is fixed to central periphery of the drive shaft 32. The piston 28 is coupled to the swash plate 34 with shoes 35 and 36. The rotation of the swash plate 34 is transmitted to each piston 28 through the shoes 35 and 36, and consequently, each piston 28 is reciprocated in the cylinder bores 11*a* and 12*a*.

A front thrust bearing 37 is located between an inner wall surface of the front cylinder block 11 and a boss 34*a* of the swash plate 34. A rear thrust bearing 38 is located between an inner wall surface of the rear cylinder block 12 and the boss 34*a*. More specifically, as shown in FIG. 2, a front end face 34*b* of the boss 34*a* is formed flat. A pressure receiving seat 11*c* of the front cylinder block 11 facing the front end face 34*b* of the boss 34*a* is formed flat and parallel to the face 34*b*. A washer 39 as a sliding bearing is located between the front end face 34*b* and the pressure receiving seat 11*c*. The washer 39 is included in the front thrust bearing 37.

An annular projection 34*d* is formed on a rear end face 34*c* of the boss 34*a*. An annular projection 12*d* is formed on the pressure receiving seat 12*c* of the rear cylinder block 12 facing the rear end face 34*c*. The projections formed on the rear end faces 34*c* on the boss portion 34*a* and that formed on the pressure receiving seat 12*c* of the rear cylinder block 12 have different diameters. A rolling bearing, such as a rear thrust bearing 38 including a needle bearing 40, is located between the projection 34*d* of the boss 34*a* and the projection 12*d* of the pressure receiving seat 12*c*. The needle bearing 40 includes an annular inner race 40*a* and outer race 40*b*. A plurality of rollers 40*c* are located between the races 40*a* and 40*b*. For absorbing dimensional tolerance when assembling the compressor, a preload based upon the fastening load of the bolts 23 is given to each pair of the cylinder blocks 11 and 12 along the axial direction of the drive shaft 32. The preload is absorbed by the elastic deformation of the inner race 40*a* and the outer race 40*b* of the needle bearing 40. Accordingly, rear thrust bearing serves as a buffer mechanism.

As shown in FIG. 1, the crank chamber 31 is connected to the suction chambers 23 and 24 via suction passages 41 and 42 in the cylinder blocks 11 and 12. The crank chamber 31 is connected to an external cooling circuit via a suction flange (not shown) formed in the cylinder blocks 11 and 12. The discharge chambers 26 and 27 are connected to the external cooling circuit via discharge passages 43 and 44 formed in the cylinder blocks 11 and 12 and in the housings 15 and 16, and a discharge flange (not shown).

In the above described compressor, rotating the drive shaft 32 rotates the swash plate in the crank chamber 31. The rotation is converted to reciprocation of the piston 28 in the cylinder bores 11*a* and 12*a* with the shoes 35 and 36. The reciprocating motion of the piston 28 draws refrigerant gas into the crank chamber 31 from the suction flange (not shown). The gas then is drawn into the suction chambers 24 and 25 via the suction passages 41 and 42. The gas in the suction chambers 24 and 25 is drawn into the compression chambers 29 and 30 to be compressed by the piston 28. The compressed gas is discharged into the discharge chambers 26 and 27 via the discharge ports 13*b* and 14*b*. The compressed refrigerant gas in the discharge chambers 26 and 27 is provided to a condenser, an expansion valve and an evaporator in an external cooling circuit via the discharge passage 43 and 44 to be used for air-conditioning a vehicle.

The above described embodiment of the present invention has the following effects.

Figure 2:
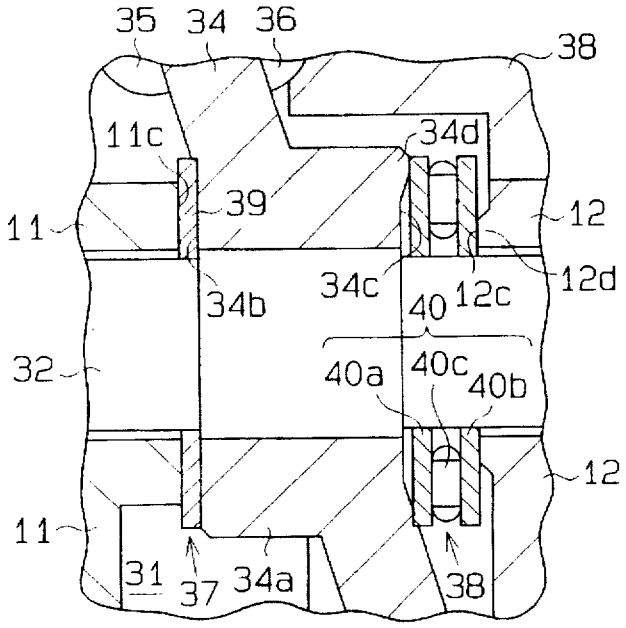
FIG. 2 is a partial enlarged sectional view of a thrust bearing portion in the compressor of FIG. 1.

(1) As shown in FIG. 2, almost the entire flat surfaces of the sides of the washer 39 included in the front thrust bearing 37 contact the front end face of the boss 34*a* of the swash plate 34 and the pressure receiving seat 11*c* of the cylinder block. This improves the rigidity of the supporting structure of the swash plate 34. The elastic deformation of the races 40*a* and 40*b* of the rear thrust bearing almost entirely absorbs the dimension tolerance of assembling. The cylinder blocks 11 and 12 continue to stably support the swash plate 34 when compression reaction forces cause the swash plate 34 to start yawing. Noise and vibration of the thrust bearings 37 and 38 are thus reduced.

(2) The simple design of the rear thrust bearing 38 absorbs the dimensional tolerances of the boss 34*a*, thrust bearings 37 and 38, and the inner walls of the cylinder blocks 11 and 12 when assembling the compressor.

Figure 3:
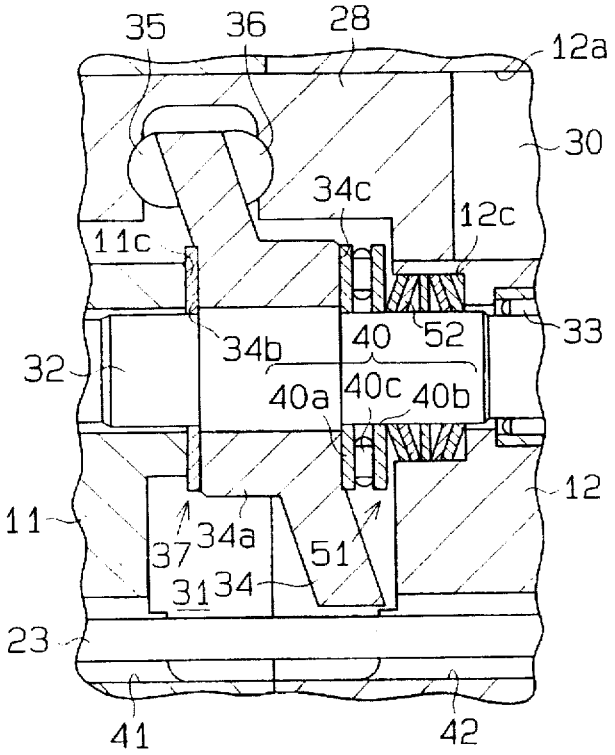
FIG. 3 is a partial sectional view of a compressor according to the second embodiment of the present invention.
Figure 4:
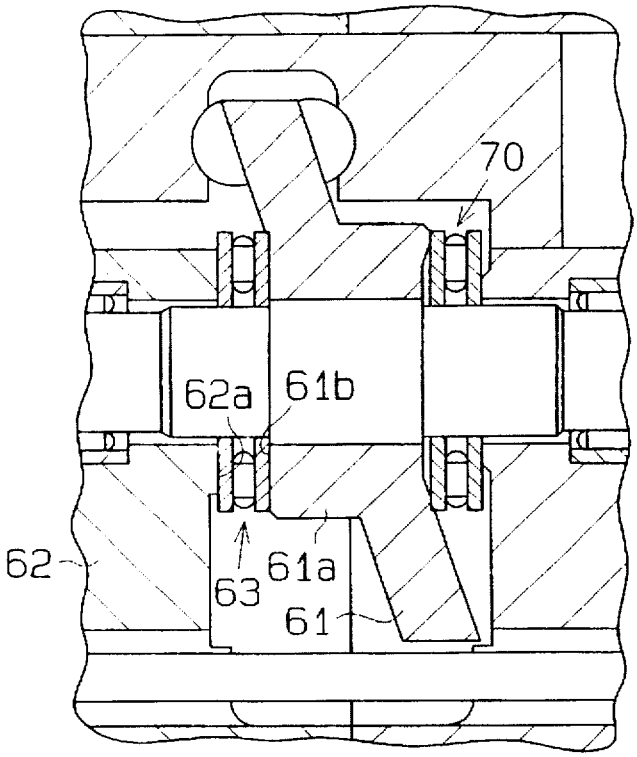
Fig.4 (Prior Art)
FIG. 4 is a partial sectional view of a conventional compressor.

In the second embodiment shown in FIG. 3, the design of the rear thrust bearing 51 is different from that of the first embodiment. The rear end face 34*c* of the boss 34*a* of the swash plate 34 and the pressure receiving seat 12*c* of the cylinder block 12 facing the rear end face 34*c* are formed flat and parallel to each other. A disc spring 52 is located between the pressure receiving seat 12*c* of the cylinder block 12 and the needle bearing 40. The disc spring serves as a buffer mechanism for absorbing axial load to the swash plate 34.

This design allows dimensional tolerances, when assembling the compressor, to be absorbed by the elastic deformation of the disc spring 52 caused by a preload given to the cylinder blocks 11 and 12.

Although only two embodiments of the present invention have been described so far, it should be apparent to those skilled in the art that the present invention may be embodied in many other specific forms without departing from the spirit or scope of the invention. Particularly, the invention may be embodied in the following forms:

(1) The designs of the front thrust bearing and the rear thrust bearing may be exchanged.

(2) A channel for introducing lubricant may be formed on at least one of the front end face 34*b* of the boss 34*a* of the swash plate 34 and the surface of the pressure receiving seat 11*c* of the front cylinder block 11. This design allows lubricant suspended in refrigerant gas to be drawn between the front end face 34*b* of the boss portion 34*a* and the washer 39 or between the pressure receiving seat 11c of the cylinder block 11 and the washer 39. This smoothes the rotation of the swash plate 34.

(3) The above described thrust bearings may be adopted in a wave cam plate type double headed piston compressor. A wave cam plate is used instead of a swash plate and has waving cam surface. In such a compressor, rotation of the wave cam allows each piston to reciprocate twice.

What is claimed is:

1. A cam plate type compressor comprising:

a housing;

a crank chamber formed within the housing;

a drive shaft;

a cam plate supported by the drive shaft and located in the crank chamber, wherein the cam plate has a rotational axis, and wherein the cam plate receives a load in the axial direction when the compressor is assembled;

a boss formed between the cam plate and the drive shaft for supporting the cam plate, the boss having first and second end surfaces axially spaced from one another, wherein the first end surface is flat;

a first bearing seat located to face the first end surface, wherein the first bearing seat is flat;

a second bearing seat located to face the second end surface;

a first bearing located between the first end surface and the first seat;

a second bearing located between the second end surface and the second seat;

a buffer means associated with one of the bearings for absorbing the axial load;

wherein one of the first and second bearings is a rolling bearing and the other is a sliding bearing.

2. The compressor according to claim 1, wherein the first bearing is the sliding bearing and the second bearing is the rolling bearing.

3. The compressor according to claim 1, wherein said sliding bearing includes an annular washer.

4. The compressor according to claim 2, wherein the second bearing has a pair of flexible races and a plurality of rollers located between the races, and wherein a first annular projection is formed on the second end surface and a second annular projection is formed on the second seat, and wherein one of the projections has a diameter that is smaller than the other, and one of the races engages one of the projections and the other race engages the other projection such that the bearing is elastically deformed when the axial load is applied to the cam plate, and wherein the first bearing is relatively rigid compared to the second bearing.

5. The compressor according to claim 1, wherein the buffer means comprises a spring member for urging one of the bearings toward the boss, and wherein the other bearing is rigidly held with respect to the housing.

6. A cam plate type compressor comprising:

a housing formed by a first casing and a second opposed casing, wherein the casings are connected to one another;

a crank chamber formed within the housing;

a drive shaft having a first and a second end, wherein the first end is supported by the first casing and the second end is supported by the second casing, wherein the drive shaft is driven to operate the compressor;

a cam plate located in the crank chamber, wherein the cam plate is supported and driven by the drive shaft, wherein the cam plate has a rotational axis, and wherein the cam plate receives a load in the axial direction when the compressor is assembled;

a boss formed between the cam plate and the drive shaft for supporting the cam plate, the boss having first and second end surfaces axially spaced from one another, wherein the first end surface is flat;

a first bearing seat connected to the first casing and located to face the first end surface, wherein the first bearing seat is flat;

a second bearing seat connected to the second casing and located to face the second end surface;

a first bearing located between the first end surface and the first seat;

a second bearing located between the second end surface and the second seat;

a buffer means associated with the second bearing for absorbing the axial load;

wherein one of the first and second bearings is a rolling bearing and the other is a sliding bearing.

7. The compressor according to claim 6, wherein the first bearing is the sliding bearing and the second bearing is the rolling bearing.

8. The compressor according to claim 6, wherein said sliding bearing includes a flat washer and is relatively rigid compared to the second bearing.

9. The compressor according to claim 7, wherein the second bearing has a pair of flexible races and a plurality of rollers located between the races, and wherein a first annular projection is formed on the second end surface and a second annular projection is formed on the second seat, and wherein one of the projections has a diameter that is smaller than the other, and one of the races engages one of the projections and the other race engages the other projection such that the bearing is elastically deformed when the axial load is applied to the cam plate.

10. The compressor according to claim 6, wherein the buffer means comprises a spring member for urging one of the bearings toward the boss.

11. A cam plate type compressor comprising:

a housing formed by a first casing and a second opposed casing, wherein the casings are connected to one another;

a crank chamber formed within the housing;

a drive shaft having a first and a second end, wherein the first end is supported by the first casing and the second end is supported by the second casing, wherein the drive shaft is driven to operate the compressor;

a cam plate located in the crank chamber, wherein the cam plate is supported and driven by the drive shaft, wherein the cam plate has a rotational axis, and wherein the cam plate receives a load in the axial direction when the compressor is assembled;

a boss formed between the cam plate and the drive shaft for supporting the cam plate, the boss having first and second end surfaces axially spaced from one another, wherein the first end surface is flat;

a first bearing seat connected to the first casing and located to face the first end surface, wherein the first bearing seat is flat;

a second bearing seat connected to the second casing and located to face the second end surface;

a first bearing located between the first end surface and the first seat, wherein the first bearing is a sliding bearing;

a second bearing located between the second end surface and the second seat, wherein the second bearing has a pair of flexible races and a plurality of rollers located between the races, and wherein a first annular projection is formed on the second end surface and a second annular projection is formed on the second seat, and wherein one of the projections has a diameter that is smaller than the other, and one of the races engages one of the projections and the other race engages the other projection such that the second bearing is elastically deformed when the axial load is applied to the cam plate; and wherein the first bearing is relatively rigidly held with respect to the housing compared to the second bearing.

* * * * *